US011205847B2

(12) United States Patent
Sherlock

(10) Patent No.: US 11,205,847 B2
(45) Date of Patent: Dec. 21, 2021

(54) 5-6 GHZ WIDEBAND DUAL-POLARIZED MASSIVE MIMO ANTENNA ARRAYS

(71) Applicant: TAOGLAS GROUP HOLDINGS LIMITED, Enniscorthy (IE)

(72) Inventor: Steafan Sherlock, Meath (IE)

(73) Assignee: TAOGLAS GROUP HOLDINGS LIMITED, Enniscorthy (IE)

( * ) Notice: Subject to any disclaimer, the term of this patent is extended or adjusted under 35 U.S.C. 154(b) by 489 days.

(21) Appl. No.: 15/885,235

(22) Filed: Jan. 31, 2018

(65) Prior Publication Data

US 2018/0219289 A1 Aug. 2, 2018

Related U.S. Application Data

(60) Provisional application No. 62/453,180, filed on Feb. 1, 2017.

(51) Int. Cl.

| | |
|---|---|
| ***H01Q 5/42*** | (2015.01) |
| ***H01Q 19/00*** | (2006.01) |
| ***H01Q 1/42*** | (2006.01) |
| ***H01Q 21/06*** | (2006.01) |

(Continued)

(52) U.S. Cl.

CPC ..... *H01Q 5/42* (2015.01); *H01Q 1/246* (2013.01); *H01Q 1/422* (2013.01); *H01Q 9/0457* (2013.01); *H01Q 19/005* (2013.01); *H01Q 21/064* (2013.01); *H01Q 21/065* (2013.01); *H01Q 21/068* (2013.01)

(58) Field of Classification Search

CPC ..... H01Q 5/42; H01Q 21/065; H01Q 9/0457; H01Q 1/246; H01Q 19/005; H01Q 1/422; H01Q 21/068; H01Q 21/064

See application file for complete search history.

(56) References Cited

U.S. PATENT DOCUMENTS 4,903,033 A * 2/1990 Tsao ..... H01Q 9/0414 343/700 MS
5,001,492 A * 3/1991 Shapiro ..... H01P 5/187 333/116

(Continued)

FOREIGN PATENT DOCUMENTS

CN 104157987 A 11/2014
CN 104882674 A 9/2015

(Continued)

OTHER PUBLICATIONS

Holland et al., "A 7-21 GHz Dual-Polarized Planar Ultrawideband Modular Antenna (PUMA) Array", IEEE Transactions on Antennas and Propagation, vol. 60, No. 10, Oct. 2012 (Year: 2012).*

(Continued)

*Primary Examiner* — Daniel Munoz
*Assistant Examiner* — Bamidele A Jegede
(74) *Attorney, Agent, or Firm* — Garson & Gutierrez, PC

(57) ABSTRACT

5-6 GHz wideband dual-polarized MIMO array antennas are disclosed. The antennas comprise a double layered PCB, a single layered PCB and a plurality of microstrip patch antennas. The microstrip patches are radiating elements which are coupled to apertures in the ground plane. The aperture coupling avoids the need for complex multi-layered boards with plated via holes. Standard SMA connectors can be used with the array antenna.

22 Claims, 15 Drawing Sheets

(51) Int. Cl.
*H01Q 9/04* (2006.01)
*H01Q 1/24* (2006.01)

(56) References Cited

U.S. PATENT DOCUMENTS 5,043,738 A * 8/1991 Shapiro ..... H01Q 5/385 343/700 MS
5,241,321 A * 8/1993 Tsao ..... H01Q 9/0435 343/700 MS
5,278,569 A * 1/1994 Ohta ..... H01Q 21/065 343/700 MS
5,293,171 A * 3/1994 Cherrette ..... H01Q 1/002 343/700 MS
5,355,143 A * 10/1994 Zurcher ..... H01Q 9/0407 343/700 MS
5,448,250 A * 9/1995 Day ..... H01Q 1/1271 343/700 MS
5,455,594 A * 10/1995 Blasing ..... H01Q 1/364 343/700 MS
5,661,494 A * 8/1997 Bondyopadhyay .... H01Q 1/364 343/700 MS
5,841,401 A * 11/1998 Bodley ..... H01Q 1/246 343/700 MS
5,896,107 A * 4/1999 Huynh ..... H01Q 9/0457 343/700 MS
5,955,994 A * 9/1999 Staker ..... H01Q 21/065 343/700 MS
5,982,326 A * 11/1999 Chow ..... H01Q 9/0435 342/365
5,995,047 A * 11/1999 Freyssinier ..... H01Q 1/38 343/700 MS
6,008,763 A * 12/1999 Nystrom ..... H01Q 9/0457 343/700 MS
6,018,320 A * 1/2000 Jidhage ..... H01Q 1/36 343/700 MS
6,054,953 A * 4/2000 Lindmark ..... H01Q 1/38 343/700 MS
6,069,587 A * 5/2000 Lynch ..... H01Q 1/38 343/700 MS
6,072,434 A * 6/2000 Papatheodorou .... H01Q 9/0421 343/700 MS
6,087,989 A * 7/2000 Song ..... H01Q 9/285 343/700 MS
6,091,364 A * 7/2000 Murakami ..... H01Q 1/084 343/700 MS
6,285,323 B1 * 9/2001 Frank ..... H01Q 21/0006 343/700 MS
6,377,217 B1 * 4/2002 Zhu ..... H01Q 21/0075 343/700 MS
6,396,440 B1 * 5/2002 Chen ..... H01Q 3/26 343/700 MS
6,538,603 B1 * 3/2003 Chen ..... H01P 1/181 342/372
6,556,168 B1 * 4/2003 Marumoto ..... H01Q 21/0087 342/372
6,559,798 B1 * 5/2003 Marumoto ..... H01Q 3/2605 342/372
6,593,891 B2 * 7/2003 Zhang ..... H01Q 1/246 343/767
6,864,840 B2 * 3/2005 Zhu ..... H01Q 3/36 343/700 MS
7,167,129 B1 1/2007 Bernd
7,423,595 B2 9/2008 Säily
7,742,000 B2 6/2010 Mohamadi
7,936,314 B2 5/2011 Kuramoto et al.
8,314,749 B2 11/2012 Shtrom et al.
9,077,070 B2 7/2015 Zimmerman et al.
9,083,068 B2 7/2015 Jones
9,407,012 B2 8/2016 Shtrom et al.
9,461,368 B2 10/2016 Azulay et al.
9,472,852 B2 10/2016 O'Shea et al.
9,716,312 B2 7/2017 Chen et al.
9,716,321 B2 7/2017 Oppenlaender et al.
9,742,077 B2 8/2017 Pan
2004/0061647 A1 * 4/2004 Roper ..... H01Q 9/0407 343/700 MS
2004/0080455 A1 * 4/2004 Lee ..... H01Q 21/065 343/700 MS
2004/0189527 A1 * 9/2004 Killen ..... H01Q 9/0414 343/700 MS
2004/0239567 A1 * 12/2004 Van Der Poel ..... H01Q 13/106 343/700 MS
2005/0057396 A1 * 3/2005 Boyanov ..... H01Q 9/0435 343/700 MS
2006/0001574 A1 * 1/2006 Petros ..... H01Q 9/0407 343/702
2008/0238793 A1 * 10/2008 Channabasappa ... H01Q 9/0457 343/767
2009/0015483 A1 * 1/2009 Liu ..... H01Q 21/0006 343/700 MS
2010/0052994 A1 * 3/2010 Llorens del Rio ..... H01Q 21/0087 343/700 MS
2011/0001682 A1 * 1/2011 Rao ..... H01Q 5/42 343/893
2011/0025574 A1 * 2/2011 Tiezzi ..... H01Q 21/065 343/824
2014/0028516 A1 1/2014 Semonov et al.
2014/0266897 A1 * 9/2014 Jakoby ..... H01Q 1/38 342/368
2015/0236425 A1 * 8/2015 Sudo ..... H01Q 9/0407 343/700 MS
2016/0079672 A1 * 3/2016 Cerreno ..... H01Q 21/065 343/848
2016/0164182 A1 * 6/2016 Lai ..... H01Q 21/0006 343/905
2016/0204514 A1 * 7/2016 Miraftab ..... H01Q 21/005 343/737
2017/0025767 A1 1/2017 Elsallal et al.
2017/0062940 A1 3/2017 Cao
2017/0104256 A1 4/2017 Bedinger et al.
2017/0179596 A1 6/2017 Diaz et al.
2017/0250473 A1 8/2017 Luk et al.
2017/0346179 A1 11/2017 Wu et al.
2018/0337456 A1 * 11/2018 Liu ..... H01Q 21/0075

FOREIGN PATENT DOCUMENTS

CN 106025526 A 10/2016
EP 2120293 A1 11/2009
EP 2795726 B1 10/2016
WO 20160138267 A1 9/2016

OTHER PUBLICATIONS

Kolmonen, et al. 5.3-GHz MIMO radio channel sounder, IEEE Transactions on Instrumentation and Measurement, vol. 55(4) Aug. 2006.

Li, et al. 60-GHz Dual-Polarized Two-Dimensional Switch-Beam Wideband Antenna Array of Aperture-Coupled Magneto Electric Dipoles, IEEE Transactions on Antennas and Propagation, vol. 64 (2), Feb. 2016.

Lu, et al., A High-Isolation Dual-Polarization Microstrip Patch Antenna With Quasi-Cross-Shaped Coupling Slot, IEEE Transactions on Antennas and Propagation, vol. 59(7), Jul. 2011.

Mao, et al., Compact Coradiator UWB-MIMO Antenna With Dual Polarization, IEEE Transactions on Antennas and Propagation, vol. 62 (9) Sep. 2014.

Steyn, et al., Dual-Band Dual-Polarized Array for WLAN Applications, Progress in Electromagnetics Research, vol. 10, pp. 151-161, Dec. 31, 2009.

Su, et al., Printed, low-cost, dual-polarized dual-loop-antenna system for 2.4/5 GHz WLAN access point, Antennas and Propagation (EUCAP), Proceedings of the 5th European Conference on Apr. 11-15, 2011.

(56) References Cited

OTHER PUBLICATIONS

Zheng, et al., Dual-Band Dual-Polarized Compact Bowtie Antenna Array for Anti-Interference MIMO WLAN, IEEE Transactions on Antennas and Propagation, vol. 62(1), Jan. 2014.

* cited by examiner

5-6 GHZ WIDEBAND DUAL-POLARIZED MASSIVE MIMO ANTENNA ARRAYS

CROSS-REFERENCE

This application claims the benefit of U.S. Provisional Application No. 62/453,180, filed Feb. 1, 2017, entitled 5-6 GHZ WIDEBAND DUAL-POLARIZED MASSIVE MIMO ARRAY which application is incorporated herein by reference.

BACKGROUND

Field

The present disclosure relates in general to an antenna and, in particular, to an antenna employing multiple-input, multiple-output (MIMO) architecture in an array.

The latest generation (5G) communications networks will provide increased broadband and robust, low-latency connectivity. Such networks place increasing demands on antenna systems, leading to increasing activity in the design and construction of MIMO antenna systems. MIMO antenna systems improve data capacity and performance for communication systems without additional bandwidth or increased transmit power. Packaging requirements for the latest MIMO antenna systems dictate placing antennas in close proximity. However, antennas in close proximity to each other are prone to performance degradation due to electromagnetic interference.

What is needed is a compact, single-panel ultra-wideband MIMO antenna system that can address the instantaneous high-bandwidth needs of multiple moving communications points while providing high gain and sufficient antenna-to-antenna isolation to meet emerging 5G communications requirements.

SUMMARY

Disclosed is a pin-fed stacked, aperture-coupled patch antenna array with dual-polarization and multiple-input, multiple-output (MIMO) architecture on a single-panel. The disclosure incorporates 64 antenna elements, which can be arranged in an orthogonal array. Each element has two feed ports, resulting in a 128-antenna array. The feeding architecture allows for unlimited antennas to be fed from the back of the panel by use of pins, connectors or waveguide feeds.

An aspect of the disclosure is directed to antennas. Antennas comprise: a first substrate; a ground plane positioned on a first side of the first substrate wherein the ground plane comprises two or more coupling apertures and two or more feed pin apertures passing through the first substrate; a micro-strip layer on a second side of the first substrate further comprising at least one pair of micro-strip elements wherein each element of the pair of micro-strip elements comprises a first end and a second end and further wherein the micro-strip element engages one of the feed pin apertures; and a second substrate positioned on the micro-strip layer of the first substrate wherein the second substrate comprises one or more patches. In some configurations, the ground plane further comprises a first coupling aperture and a second c-shaped coupling aperture. Additionally, the pair of micro-strip elements can be configured to further comprise a first leg positioned substantially perpendicular to a second leg. The first leg and second leg can meet at a sharp 90 degree corner or a curved corner. In some configurations, the first leg and the second leg have the same length, in other configurations, the first leg and the second leg have different lengths. The antenna can also be configured to include an array of coupling apertures, feed pin apertures, micro-strip elements, and patches. In some configurations, the array further comprises 64 antenna elements. The 64 antenna element array can have a >28 dBi effective peak gain. In some configurations, the antenna is configured to have a 5-6 GHz wideband dual-polarized MIMO array antenna. Each aperture coupled patch can also have a >7 dBi peak gain.

Another aspect of the disclosure is directed to single panel MIMO arrays. Suitable single panel MIMO arrays are configurable to comprise: a first substrate; a ground plane positioned on a first side of the first substrate wherein the ground plane comprises a row of aperture clusters in a first direction and a column of aperture clusters in a second direction; a micro-strip layer on a second side of the first substrate further comprising a row of micro-strip elements in a first direction and a column of micro-strip elements in a second direction wherein each element of the micro-strip elements comprises a first end and a second end and further wherein each of the micro-strip element engages a feed pin aperture of one of the aperture clusters on the ground plane; and a second substrate positioned on the micro-strip layer of the first substrate wherein the second substrate comprises a row of patches in a first direction and a column of patches in a second direction, wherein the array has an effective peak gain>28 dBi. In at least some configurations, each aperture cluster can further comprises a first coupling aperture and a second c-shaped coupling aperture. Additionally, the pair of micro-strip elements can be configured to have a first leg positioned substantially perpendicular to a second leg. The first leg and second leg can meet at a sharp 90 degree corner or a curved corner. The first leg and the second leg can have the same length or can have different lengths. In some configurations, the array has 64 antenna elements. Additionally, the antenna can have, for example, a 5-6 GHz wideband dual-polarized MIMO array antenna. In at least some configurations, each aperture coupled patch has >7 dBi peak gain.

Still another aspect of the disclosure is directed to methods of transmitting and receiving data. Suitable methods comprise: providing a first substrate, a ground plane positioned on a first side of the first substrate wherein the ground plane comprises a row of aperture clusters in a first direction and a column of aperture clusters in a second direction, a micro-strip layer on a second side of the first substrate further comprising a row of micro-strip elements in a first direction and a column of micro-strip elements in a second direction wherein each element of the micro-strip elements comprises a first end and a second end and further wherein each of the micro-strip element engages a feed pin aperture of one of the aperture clusters on the ground plane, and a second substrate positioned on the micro-strip layer of the first substrate wherein the second substrate comprises a row of patches in a first direction and a column of patches in a second direction; achieving an effective peak gain>28 dBi; achieving >1 GHz 10 dB bandwidth across 5-6 GHz; and at least one of transmitting data and receiving data.

Yet another aspect of the disclosure is directed to antenna systems. Suitable systems comprise: a mounting device further comprising a first surface engaging a plurality of SMA connectors, a pair of arms, and a cable holder positioned between the pair of arms, an antenna comprising a first substrate, a ground plane positioned on a first side of the first substrate wherein the ground plane comprises two or more coupling apertures and two or more feed pin apertures passing through the first substrate, a micro-strip layer on a second side of the first substrate further comprising at least one pair of micro-strip elements wherein each element of the pair of micro-strip elements comprises a first end and a second end and further wherein the micro-strip element engages one of the feed pin apertures, and a second substrate positioned on the micro-strip layer of the first substrate wherein the second substrate comprises one or more patches wherein the antenna engages the first surface of the mounting device; and a plurality of cables.

Another aspect of the disclosure is directed to antenna kits. Suitable kits comprise: a mounting device further comprising a first surface engaging a plurality of SMA connectors, a pair of arms, and a cable holder positioned between the pair of arms, an antenna comprising a first substrate, a ground plane positioned on a first side of the first substrate wherein the ground plane comprises two or more coupling apertures and two or more feed pin apertures passing through the first substrate, a micro-strip layer on a second side of the first substrate further comprising at least one pair of micro-strip elements wherein each element of the pair of micro-strip elements comprises a first end and a second end and further wherein the micro-strip element engages one of the feed pin apertures, and a second substrate positioned on the micro-strip layer of the first substrate wherein the second substrate comprises one or more patches wherein the antenna engages the first surface of the mounting device; a plurality of SMA connectors; and a plurality of cables.

INCORPORATION BY REFERENCE

All publications, patents, and patent applications mentioned in this specification are herein incorporated by reference to the same extent as if each individual publication, patent, or patent application was specifically and individually indicated to be incorporated by reference. See:

CN-104157987-A to Hong et al. published Nov. 19, 2014;
CN-104882674-A to Li et al. published Sep. 2, 2015;
CN-106025526-A to Liu et al. published Oct. 12, 2016;
EP-2120293-A1 to Kildal published Nov. 18, 2009;
EP-2795726-B1 to Motta et al. issued Oct. 5, 2016;
US-2014/0028516-A1 to Semonov et al. published Jan. 30, 2014;
US-2017/0025767-A1 to Elsallal et al. published Jan. 26, 2017;
US-2017/0062940-A1 to Cao published Mar. 2, 2017;
US-2017/0104256-A1 to Bedinger et al. published Apr. 13, 2017;
US-2017/0179596-A1 to Diaz et al. published Jun. 22, 2017;
US-2017/0250473-A1 to Luk et al. published Aug. 31, 2017;
US-2017/0346179-A1 to Wu et al. published Nov. 30, 2017;
U.S. Pat. No. 6,087,989-A to Song et al. issued Jul. 11, 2000;
U.S. Pat. No. 7,167,129-B1 to Bernd issued Jan. 23, 2007;
U.S. Pat. No. 7,423,595-B2 to Säily issued Sep. 9, 2008;
U.S. Pat. No. 7,742,000-B2 to Mohamadi issued Jun. 22, 2010;
U.S. Pat. No. 7,936,314-B2 to Kuramoto et al. issued May 3, 2011;
U.S. Pat. No. 8,314,749-B2 to Shtrom et al. issued Nov. 20, 2012;
U.S. Pat. No. 9,077,070-B2 to Zimmerman et al. issued Jul. 7, 2015;
U.S. Pat. No. 9,083,068-B2 to Jones issued Jul. 14, 2015;
U.S. Pat. No. 9,407,012-B2 to Shtrom et al. issued Aug. 2, 2016;
U.S. Pat. No. 9,461,368-B2 to Azulay et al. issued Oct. 4, 2016;
U.S. Pat. No. 9,472,852-B2 to O'Shea et al. issued Oct. 18, 2016;
U.S. Pat. No. 9,716,312-B2 to Chen et al. issued Jul. 25, 2017;
U.S. Pat. No. 9,716,321-B2 to Oppenlaender et al. issued Jul. 25, 2017;
U.S. Pat. No. 9,742,077-B2 to Pan issued Aug. 22, 2017;
WO-2016/138267-A1 to Vouvakis et al. published Sep. 1, 2016;
KOLMONEN, et al. 5.3-GHz MIMO radio channel sounder, IEEE Transactions on Instrumentation and Measurement, Vol. 55(4) August 2006;
LI, et al. 60-GHz Dual-Polarized Two-Dimensional Switch-Beam Wideband Antenna Array of Aperture-Coupled Magneto Electric Dipoles, IEEE Transactions on Antennas and Propagation, Volume: 64 (2), February 2016;
LU, et al., A High-Isolation Dual-Polarization Microstrip Patch Antenna With Quasi-Cross-Shaped Coupling Slot, IEEE Transactions on Antennas and Propagation, Vol. 59(7), July 2011;
MAO, et al., Compact Coradiator UWB-MIMO Antenna With Dual Polarization, IEEE Transactions on Antennas and Propagation, Vol. 62 (9) September 2014;
STEYN, et al., DUAL-BAND DUAL-POLARIZED ARRAY FOR WLAN APPLICATIONS, Progress in Electromagnetics Research, Vol. 10, pp. 151-161, Dec. 31, 2009;
SU, et al., Printed, low-cost, dual-polarized dual-loop-antenna system for 2.4/5 GHz WLAN access point, Antennas and Propagation (EUCAP), Proceedings of the 5th European Conference on Apr. 11-15, 2011; and
ZHENG, et al., Dual-Band Dual-Polarized Compact Bowtie Antenna Array for Anti-Interference MIMO WLAN, IEEE Transactions on Antennas and Propagation, Vol. 62(1), January 2014.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1A:
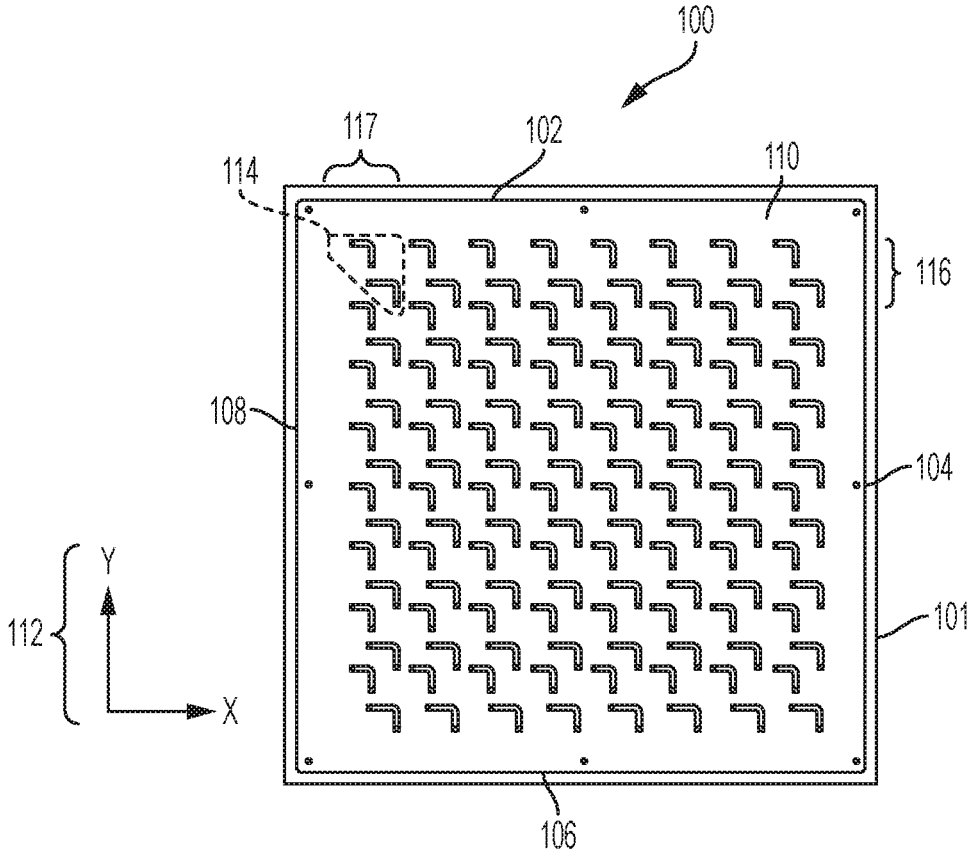
FIG. 1A illustrates the front of the lower substrate of an antenna array according to the disclosure.

Disclosed are microstrip patch antennas. The microstrip patch antennas are stacked, aperture-coupled patch antenna arrays with dual-polarization and multiple-input, multiple-output (MIMO) architecture. The antenna array incorporates 64 antenna elements, arranged in a symmetrical array. Other symmetrical array configurations can be used in Massive MIMO architecture. A single stacked patch in this array can be used as a high gain broadband patch solution. This can be expended into a modular design with an unlimited number of antennas in the array. Each antenna element incorporates two ports for dual polarization. With 64 antenna elements, the result is a 128-antenna wireless antenna system.

The disclosed antenna array utilizes a double layered printed circuit board (PCB) and a single layered PCB with no vias. An aperture coupled-feed with a two-layer substrate stack is provided for increased bandwidth. The antenna is dual linear polarized which allows the antenna to transmit on one polarization and receive on another, opposing, polarization. This configuration results in zero interference between transmitting and receiving signals. The microstrip patches are used as radiating elements which are coupled with apertures in the ground plane to excite radiation in a desired frequency. Thus, the design allows for phase shift needed for beam steering and is suitable for 5G applications where high gain directive beams can be used to address high-bandwidth demands. The disclosed antenna array uses aperture coupling forms of excitation (which is non-contact) which avoids the need to provide complex multi-layered boards.

The disclosed antenna array can be used with standard off-the-shelf SubMiniature Version A (SMA) connectors, along with common soldering techniques as a result of the aperture coupling feed structure. SMA pins can be easily accessed and soldered to the microstrip feed lines. The SMA connectors can also be bolted to a conductive back panel with the pin extended though the optimized airgap between substrates to be soldered onto the microstrip feed lines. The back plate is grounded to the PCB ground layer by conductive spaces fixed between the conductive back panel and the PCB. This allows the SMA connectors to bear the weight of RF cables leading from each antenna port. The conductive back plate also acts as a reflector, increasing the gain of each directive antenna element.

The stacked substrate design enables ultra-wide bandwidth (UWB) coverage, e.g. 1 GHz 10 dB instantaneous bandwidth, with the aperture coupling design allowing greater peak gain per antenna versus that of a typical patch antenna. The massive MIMO architecture allows for data to be transmitted and received over multiple antennas which increases coverage and capacity gain with no additional power or bandwidth requirement.

The disclosed antenna array comprises a two-layer substrate stack consisting of a first substrate (e.g., lower substrate) and a second substrate (e.g., an upper substrate). Each of the two substrates is illustrated as square and substantially planar with a substantially uniform thickness. The length and width of the lower substrate can be identical to the length and width of the upper substrate. The lower substrate is formed of dielectric material with copper cladding, an example of which is double-layered Rogers 4750 board. The back side of the lower substrate forms the ground plane; it contains an array of apertures, a number of which facilitate the passage of pin-mount SMA connectors to elements on the front side of the lower substrate. The front side of the lower substrate contains an array of metal micro-strip lines which serve as radiating elements. The upper substrate is a single-layer dielectric material. The back side of the upper substrate contains an array of radiating metal patches, whose step-size matches that of the metal micro-strip lines on the lower substrate. The back side of the upper substrate is aligned with and secured to the front side of the lower substrate so that the radiating features on each substrate align, forming an array of combined patch/micro-strip radiating features.

Turning now to FIG. 1A, a front surface of a lower substrate 100 of an exemplar antenna array according to the disclosure is illustrated. The lower substrate 100 is a dielectric with copper cladding, such as a double layered PCB 101. In this embodiment lower substrate 100 is square and substantially planar, with a first lower substrate side 102, a second lower substrate side 104, a third lower substrate side 106 and a fourth lower substrate side 108, numbered clockwise as viewed from above. A reference coordinate system 112 is provided to assist in description of the disclosure. The first lower substrate side 102 and third lower substrate side 106 are parallel to each other at an end and aligned with the x-axis of reference coordinate system 112. The second lower substrate side 104 and fourth lower substrate side 108 are parallel each other and perpendicular to the first lower substrate side 102 and the third lower substrate side 106 and aligned with the y-axis of reference coordinate system 112. Other relationships of the substrate sides can be employed without departing from the scope of the disclosure.

Upon the lower substrate front surface 110, resides a plurality of micro-strip pair 114 elements. The micro-strip pair 114 elements are shown arranged on the lower substrate front surface 110 in a square, orthogonal array whose row and column axes are aligned, respectively, with the x- and y-axes of reference coordinate system 112. Other configurations can be used without departing from the scope of the disclosure. The micro-strip pair 114 elements are regularly and uniformly spaced across both row and column dimensions. As illustrated, the micro-strip pair 114 elements number eight per array row 116 and eight per array column 117. There are eight array rows 116 on lower substrate front surface and eight array columns 117, resulting in a total of sixty-four micro-strip pair 114 elements in the array on lower substrate front surface 110.

Figure 1B:
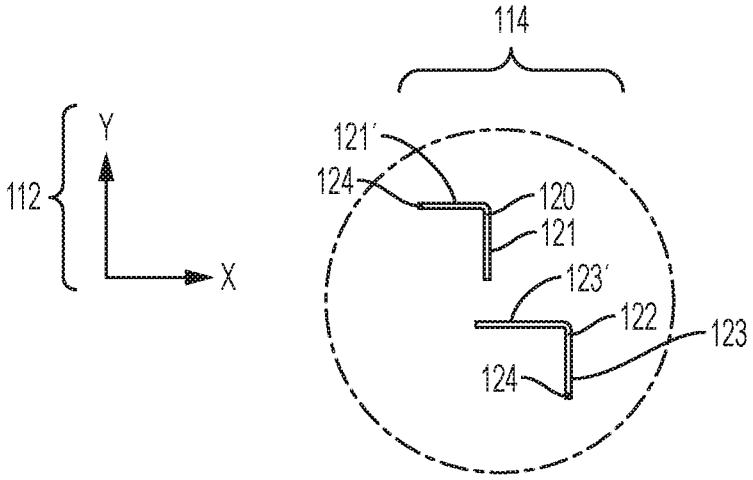
FIG. 1B illustrates the detail of micro-strip radiating features on the lower substrate of an antenna array according to the disclosure.

FIG. 1B illustrates the details of an example of a micro-strip pair 114 on the lower substrate 100 of an antenna array according to the disclosure. The micro-strip pair 114 includes a short micro-strip 120 and a long micro-strip 122. Both the short micro-strip 120 and the long micro-strip 122 are L-shaped and either or both are made of metal. The legs 121, 121' of the short micro-strip 120 are of equal length, while the long micro-strip 122 has a short leg 123 which is approximately 15% greater than the leg length of the short micro-strip 120 and a long leg 123' which is, for example, approximately 31% greater than the leg of the short micro-strip 120. At one end of each leg of both the short micro-strip 120 and the long micro-strip 122 is a feed-pin aperture 124. As is evident in FIG. 1B, the short micro-strip 120 and the long micro-strip 122 are arranged in staggered fashion such that the long micro-strip 122 is located beneath and to the right of the short micro-strip 120 when viewed in the context established in FIG. 1A. Note that the feed-pin aperture 124 is at opposite ends of the micro-strip pair 114. The whole array can be scaled to operate at any frequency. As an example, for a center frequency of operation of 5.5 GHz, the microstrip feed line elements can have a thickness of about 2.3 mm.

Figure 1C:
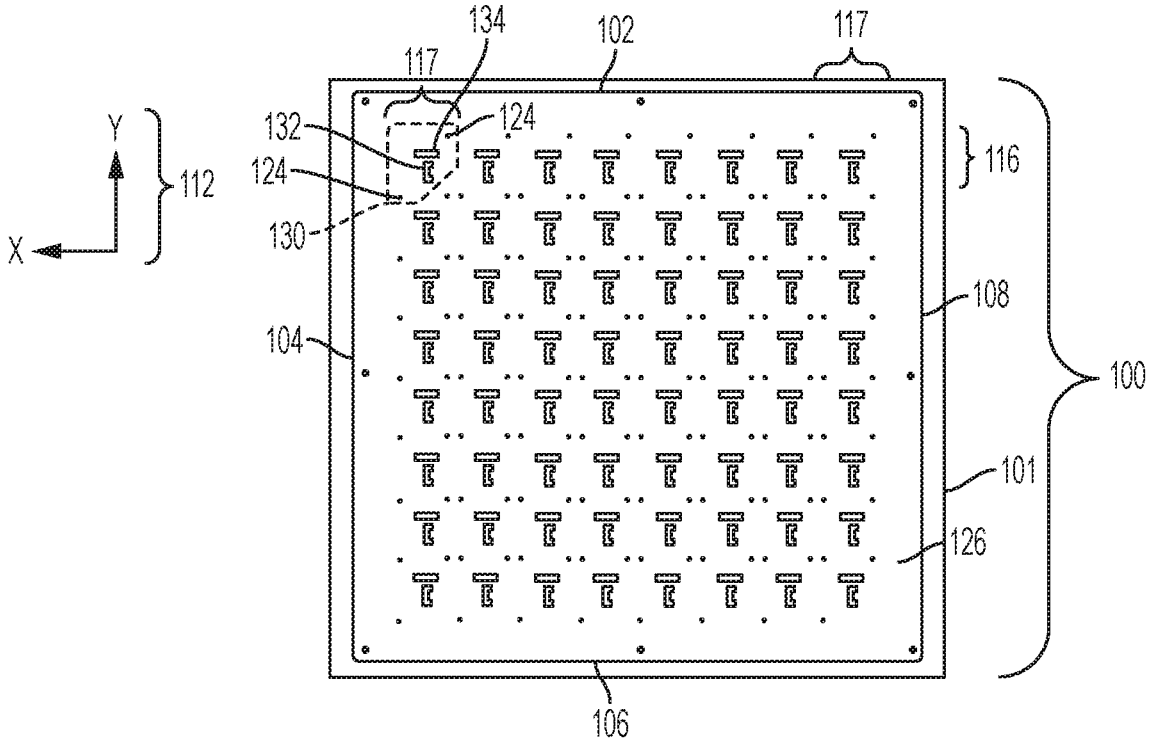
FIG. 1C illustrates the back of the lower substrate of an antenna array according to the disclosure.

FIG. 1C illustrates the back surface of the lower substrate 100 of the double layered PCB 101 of an exemplar antenna array according to the disclosure. As described in FIG. 1A, the lower substrate 100 is illustrated as square and substantially planar, with a first lower substrate side 102, a second lower substrate side 104, a third lower substrate side 106 and a fourth lower substrate side 108, numbered counter-clockwise as viewed from above. Upon lower substrate 100 back surface 126, resides the backside aperture clusters 130. The backside aperture clusters 130 are arranged on the lower substrate 100 back surface 126 in a square, orthogonal array whose row and column axes are aligned, respectively, with the x- and y-axes of reference coordinate system 112. Each backside aperture cluster 130 consists of a pair of feed-pin apertures 124 (which pass through the lower substrate as shown in FIG. 1B), a first coupling aperture 132 and a second coupling aperture 134. The first coupling aperture 132 can be rectangular, as illustrated. Alternative configurations include, but are not limited to c-slot, l-slot, -slot, curved slot, etc. The second coupling aperture 134 can be c-shaped, as illustrated. The first coupling aperture 132 has its long axis aligned with the x-axis; the second coupling aperture 134 has its long axis aligned with the y-axis. As viewed from above, the second coupling aperture 134 is positioned beneath and to the right of midpoint of the long axis of the first coupling aperture 132. The backside aperture clusters 130 are regularly and uniformly spaced across both row and column dimensions, numbering eight per array row 116 and eight per column row 117, and resulting in a total of sixty-four of the backside aperture clusters 130 in the array on lower substrate 100 back surface 126. The whole array can be scaled with frequency. As an example, with a center frequency of 5.5 GHz, the patch sizes can have a diameter of about 20 mm. The size of the patches, apertures and microstrip lines also depends on substrate selection.

Figure 2:
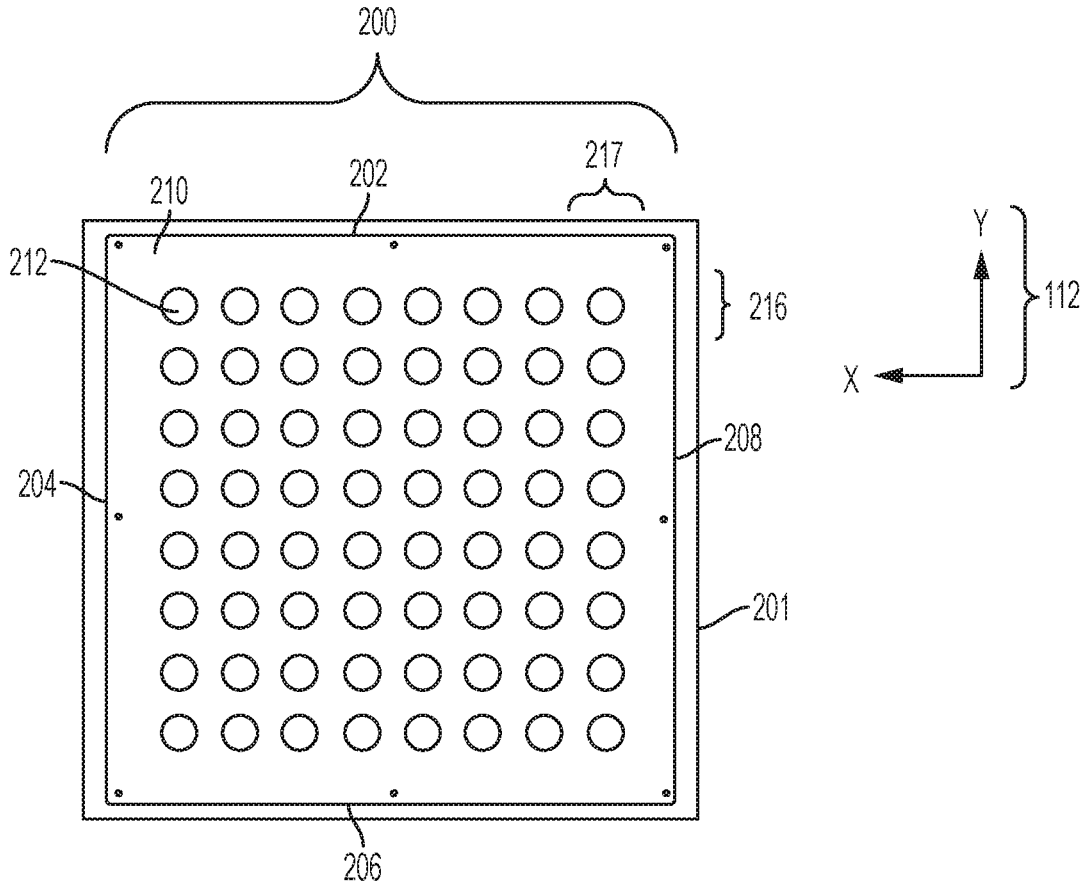
FIG. 2 illustrates the back of the upper substrate of an antenna array according to the disclosure.

FIG. 2 illustrates the back of the upper substrate 200 having a single layered PCB 201 of an exemplar antenna array according to the disclosure. In this embodiment, the upper substrate 200 is square and planar, with overall dimensions matching those of lower substrate 100 (FIG. 1A). Upper substrate 200 has a first upper substrate side 202, a second upper substrate side 204, a third upper substrate side 206 and a fourth upper substrate side 208, numbered counter-clockwise as viewed from above. First upper substrate side 202 and second upper substrate side 204 are aligned with the x-axis of reference coordinate system 112; third upper substrate side 106 and fourth upper substrate side 108 are aligned with the y-axis of reference coordinate system 112. Upon upper substrate back surface 210, reside the metal patch elements 212. The metal patch elements 212 are arranged on the upper substrate back surface 210 in a square, orthogonal array whose row and column axes are aligned, respectively, with the x- and y-axes of reference coordinate system 112. The metal patch elements 212 are regularly and uniformly spaced across both row and column dimensions, matching exactly the spacing of micro-strip pair 114 elements (FIG. 1A). There are eight array rows 216 and eight columns 217 on upper substrate front surface, resulting in a total of sixty-four of the metal patch elements 212 in the array on upper substrate back surface 210.

Figure 3A:
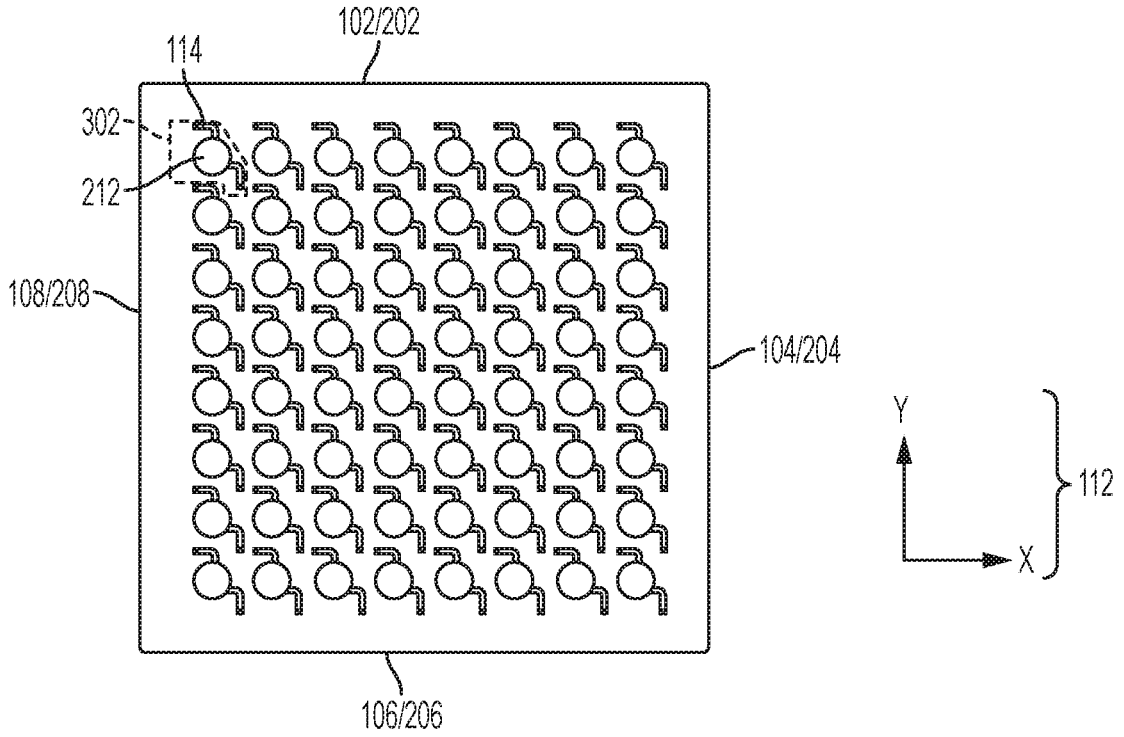
FIG. 3A illustrates the combined patch/micro-strip radiating features of an antenna array from a top view according to the disclosure.

FIG. 3A illustrates the combined patch/micro-strip radiating features of an exemplar antenna array according to the disclosure. For reference, first lower substrate side 102, second lower substrate side 104, third lower substrate side 106 and fourth lower substrate side 108, numbered clockwise as viewed from above are called out as are first upper substrate side 202, second upper substrate side 204, third upper substrate side 206 and fourth upper substrate side 208. Note the exact alignment of first lower substrate side 102 and first upper substrate side 202; second lower substrate side 104 and second upper substrate side 204; third lower substrate side 106 and third upper substrate side 206; and fourth lower substrate side 108 and fourth upper substrate side 208. Each micro-strip pair 114 element combines with its corresponding metal patch elements 212 to form patch/micro-strip element 302, of which there are sixty-four in the antenna array. The patch elements are positioned so that they are over at least one end of a micro-strip element when the layers are stacked.

To characterize performance of the antenna array, a number of simulations were performed for an exemplar 2×1 antenna array with four ports. Because each antenna element is identical in the disclosed 8×8 array, it is expected that many data curves will overlap almost exactly. This characteristic is borne out in results of the simulation. Furthermore, it is expected that the results of the simulation for a 2×1 array may be extended to those for the 8×8 antenna array of the disclosure.

Figure 3B:
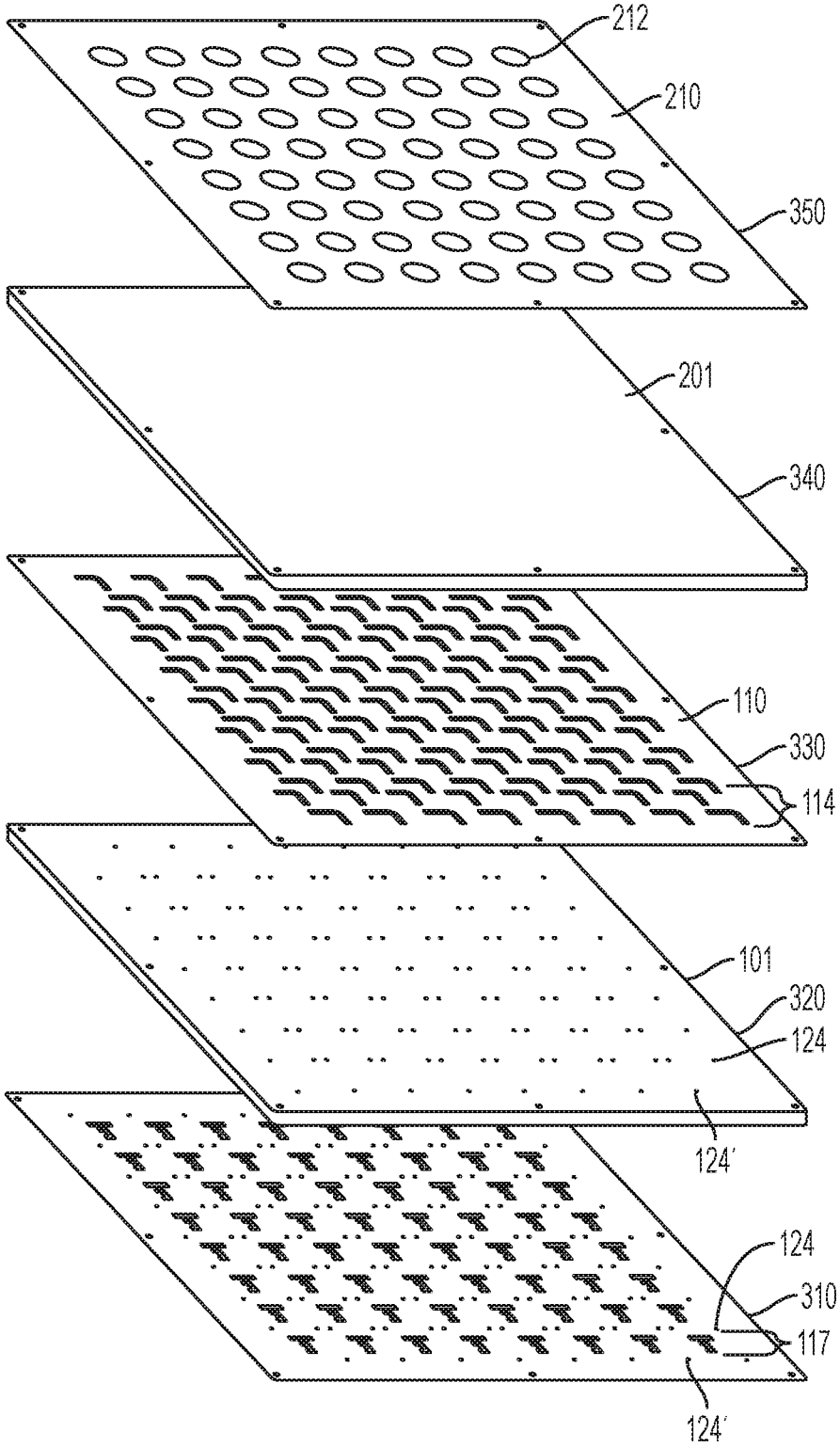
FIG. 3B is an exploded view of the layers of the antenna array according to the disclosure.

FIG. 3B is an exploded view of the layers of the antenna array. A bottom layer 310 is provided which is positioned on a bottom surface of a two-sided substrate 320. A top surface of the two-sided substrate 320 has a top layer 330. A one-sided substrate 340 is then positioned next. The one-sided substrate 340 has an upper layer 350.

The bottom layer 310 has backside aperture cluster 130 which consist of a pair of feed-pin apertures 124, a first coupling aperture 132 and a second coupling aperture 134. The two-sided substrate 320 has feed-pin apertures 124 that pass from the bottom layer 310 to the top layer 330. The top layer 330 has a plurality of micro-strip pair 114 elements. The upper layer 350 has metal patch elements 212.

TABLE 1

| Exemplar Dimensions | | | |
|---|---|---|---|
| Layer | Length (mm) | Width (mm) | Thickness (mm) |
| Bottom Layer | 315 | 315 | 0.033 |
| Two-sided substrate | 315 | 315 | 0.8 |
| Top Layer | 315 | 315 | 0.033 |
| One-sided substrate | 315 | 315 | 0.8 |
| Upper Layer | 315 | 315 | 0.033 |

As will be appreciated by those skilled in the art, the dimensions provided in Table 1 are provided as an example of dimensions for purposes of illustration. The dimensions can be scaled up or down depending on a variety of factors including, but not limited to, desired frequency and substrate material used.

Figure 4:
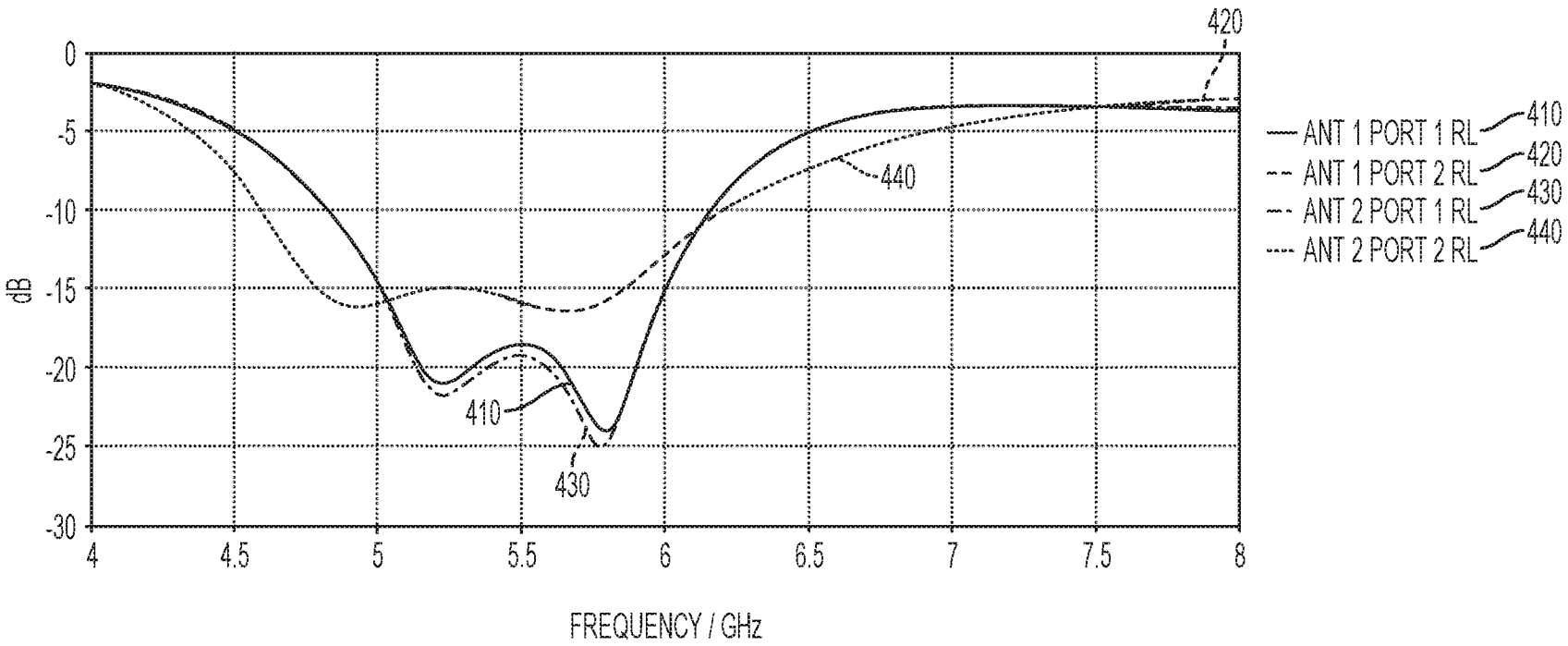
FIG. 4 is a plot of simulated return loss of an antenna array according to the disclosure.

FIG. 4 is a plot of the simulated return loss from 4 GHz to 8 GHz for a 2×1 antenna array. Traces on the plot represent results for antenna 1 port 1 return loss 410, antenna 1 port 2 return loss 420, antenna 2 port 1 return loss 430 and antenna 2 port 2 return loss 440. Note that the results for antenna 1 port 1 return loss 410 and antenna 2 port 1 return loss 430 are almost identical, deviating from one another only slightly from approximately 5.1 GHz to approximately 5.8 GHz. The results for antenna 1 port 2 return loss 420 and antenna 2 port 2 return loss 440 are so close as to be indistinguishable on the plot.

Figure 5:
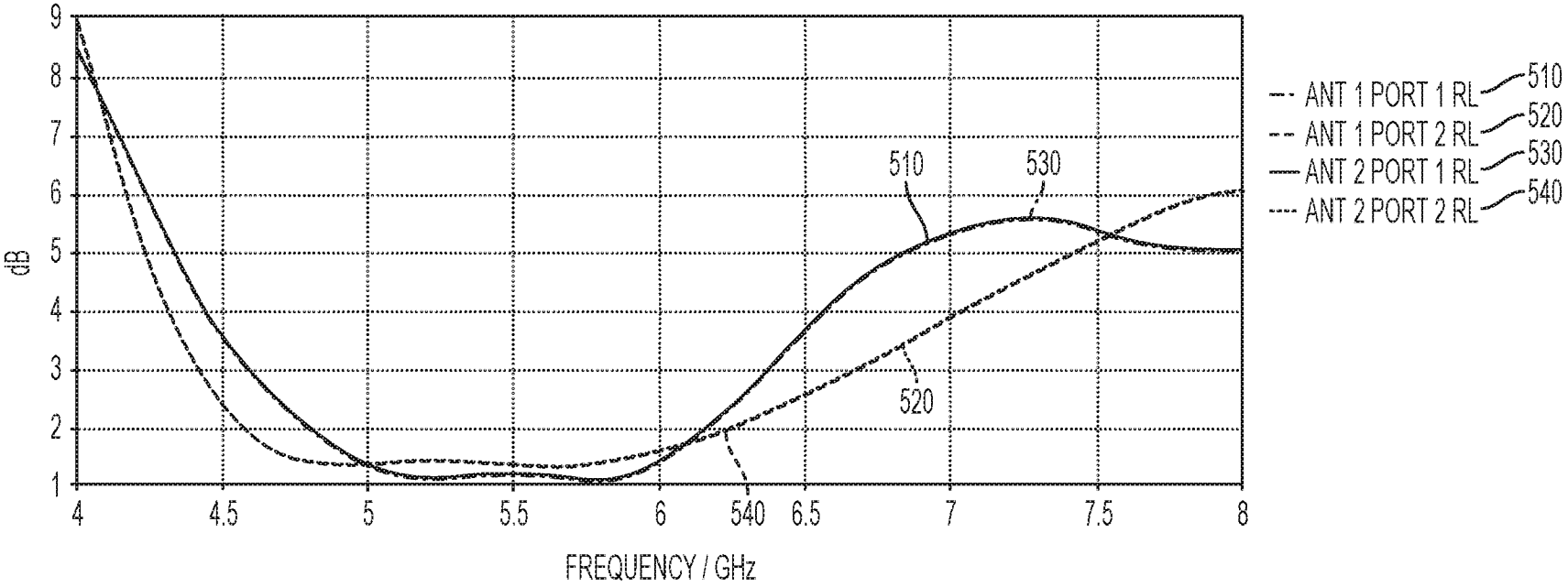
FIG. 5 is a plot of simulated voltage standing wave ratio (VSWR) of an antenna according to the disclosure.

FIG. 5 is a plot of the simulated VSWR from 4 GHz to 8 GHz for a 2×1 antenna array according to the disclosure. Traces on the plot represent results for antenna 1 port 1 VSWR 510, antenna 1 port 2 VSWR 520, antenna 2 port 1 VSWR 530 and antenna 2 port 2 VSWR 540. Note that the results for antenna 1 port 1 VSWR 510 and antenna 2 port 1 VSWR 530 are so close as to be indistinguishable on the plot, as are the results for antenna 1 port 2 VSWR 520 and antenna 2 port 2 VSWR 540.

Figure 6:
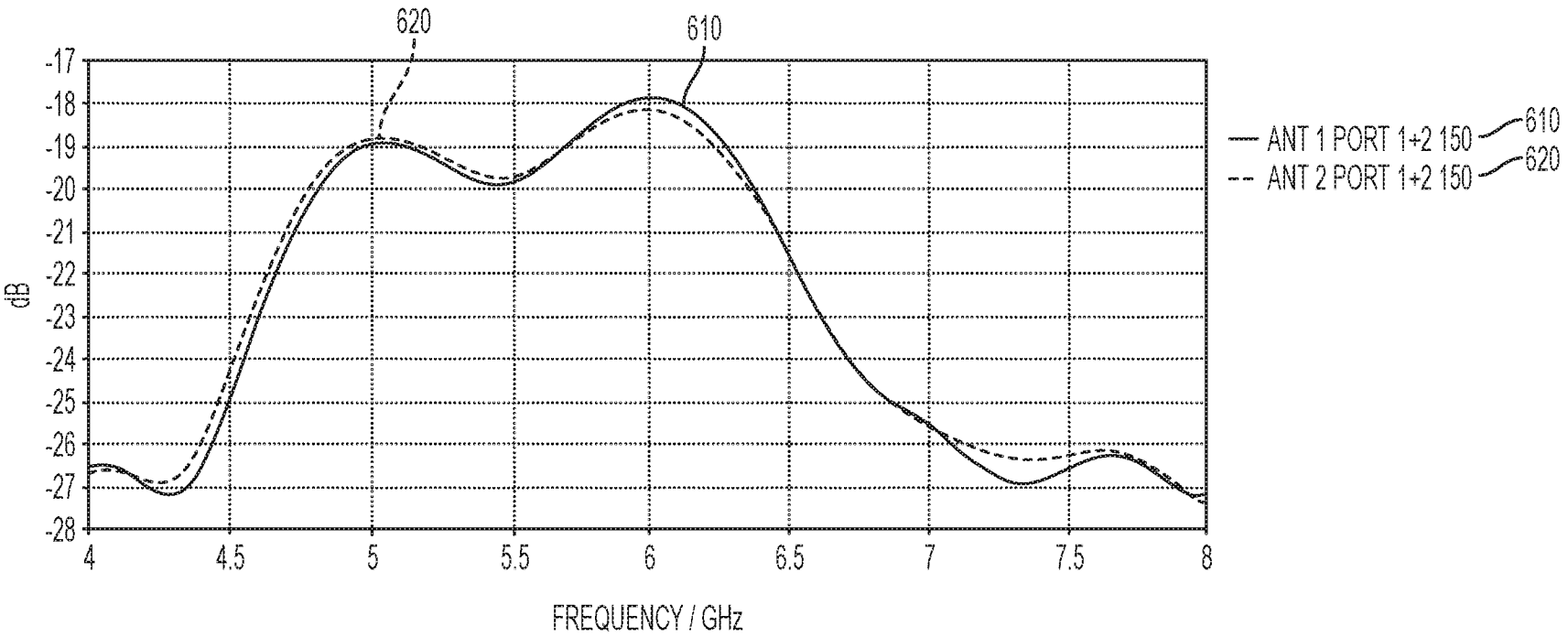
FIG. 6 is a plot of simulated isolation between two ports of an antenna in an antenna array according to the disclosure.

FIG. 6 is a plot of the simulated port-to-port isolation for each 2-port antenna from 4 GHz to 8 GHz in a 2×1 antenna array according to the disclosure. Traces on the plot represent results for antenna 1: port 1/port 2 isolation 610, and antenna 2: port 1/port 2 isolation 620. In the 5 GHz-6 GHz frequency domain, antenna 1: port 1/port 2 isolation 610 ranges from approximately −17.9 dB at 6.0 GHz to approximately −19.9 dB at approximately 5.4 GHz. Similarly, antenna 2: port 1/port 2 isolation 620 ranges from approximately −18.1 dB at 6.0 GHz to approximately −19.7 dB at approximately 5.45 GHz within the 5 GHz-6 GHz frequency domain.

Figure 7:
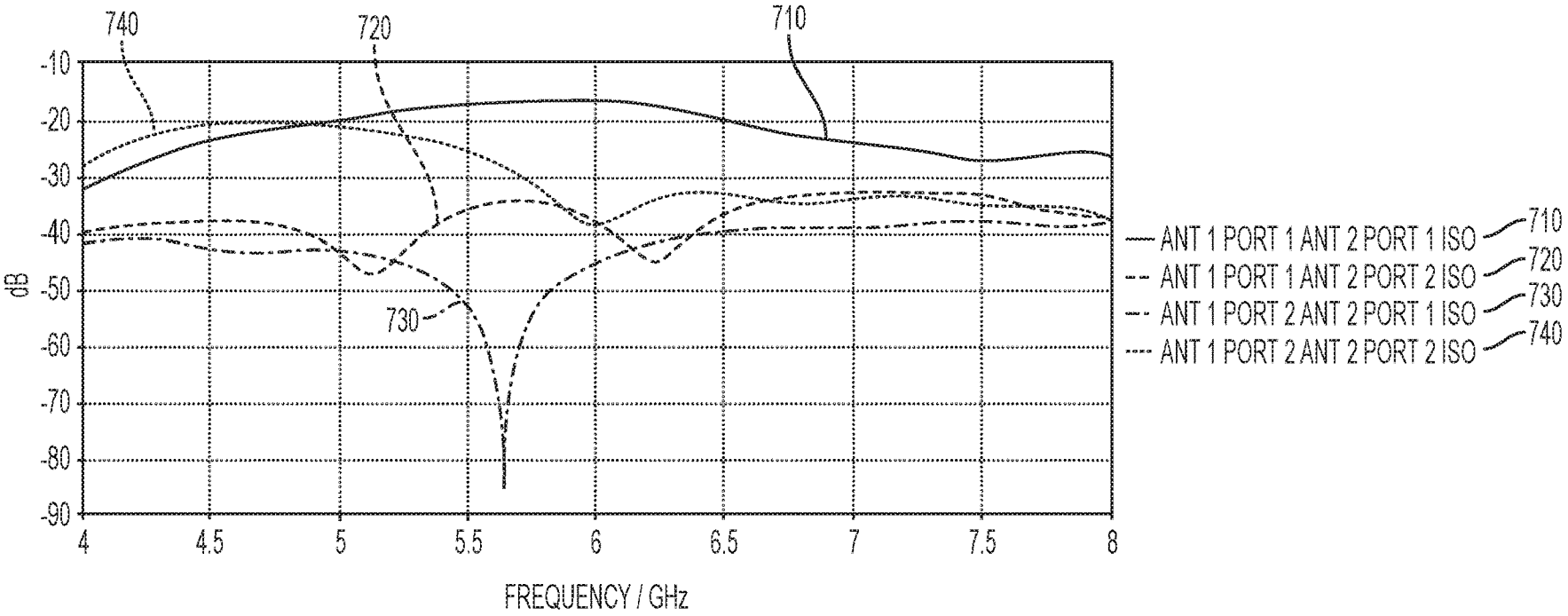
FIG. 7 is a plot of simulated isolation between two antennas of an antenna array according to the disclosure.

FIG. 7 is a plot of the simulated isolation between the two 2-port antennas from 4 GHz to 8 GHz in a 2×1 antenna array according to the disclosure. Traces on the plot represent results for antenna 1 port 1/antenna 2 port 1 isolation 710, antenna 1 port 1/antenna 2 port 2 isolation 720, antenna 1 port 2/antenna 2 port 1 isolation 730 antenna 1 port 2/antenna 2 port 2 isolation 740. In the 5 GHz-6 GHz frequency domain, the order of isolation of the antenna/port pairs from greatest to least is antenna 1 port 2/antenna 2 port 1 isolation 730, followed by antenna 1 port 1/antenna 2 port 2 isolation 720, followed, in turn by antenna 1 port 2/antenna 2 port 2 isolation 740, and finishing with antenna 1 port 1/antenna 2 port 1 isolation 710, which exhibits the least isolation of any of the antenna/port pairs.

Figure 8:
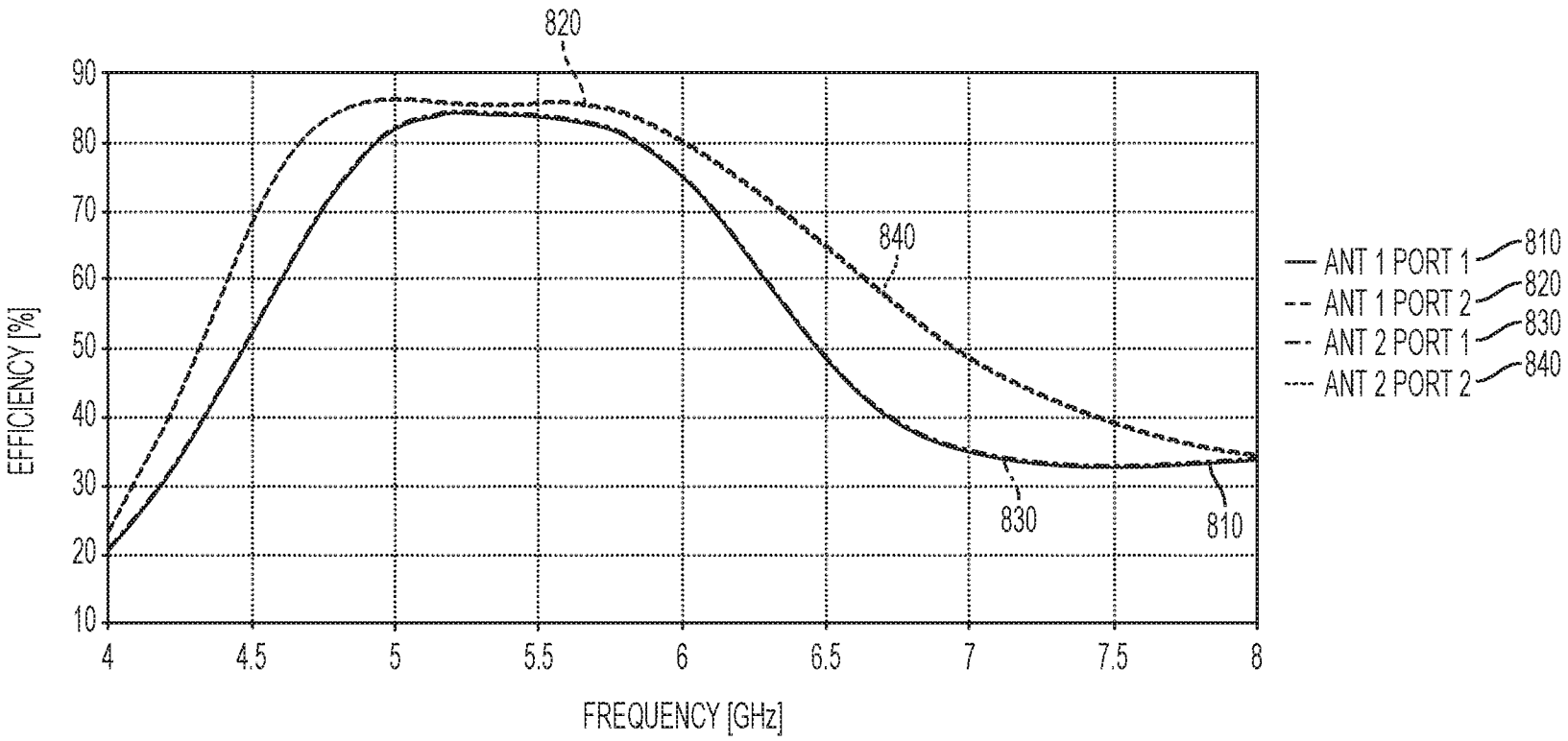
FIG. 8 is a plot of simulated efficiency of an antenna array according to the disclosure.

FIG. 8 is a plot of the simulated efficiency from 4 GHz to 8 GHz for a 2×1 antenna array according to the disclosure. Traces on the plot represent results for antenna 1 port 1 efficiency 810, antenna 1 port 2 efficiency 820, antenna 2 port 1 efficiency 830, and antenna 2 port 2 efficiency 840. Note that the results for antenna 1 port 1 efficiency 810 and antenna 2 port 1 efficiency 830 are so close as to be indistinguishable on the plot, as are the results for antenna 1 port 2 efficiency 820 and antenna 2 port 2 efficiency 840. In the 5 GHz-6 GHz frequency domain, antenna 1 port 1 efficiency 810 and antenna 2 port 1 efficiency 830, range from a maximum value of approximately 84% at 5.2 GHz to a minimum value of approximately 75% at 6.0 GHz. Similarly, antenna 2 port 1 efficiency 830 and antenna 2 port 2 efficiency 840, range from a maximum value of approximately 85% at 5 GHz to a minimum value of approximately 80% at 6.0 GHz.

Figure 9:
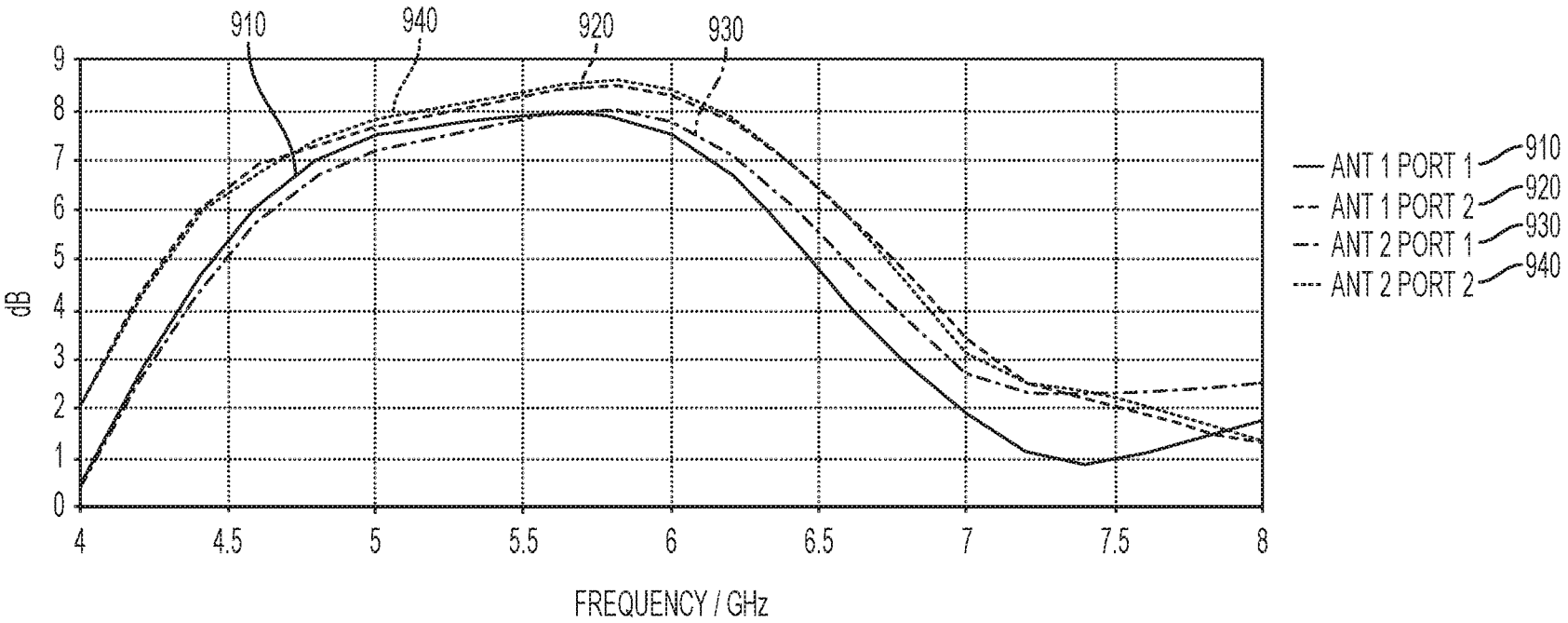
FIG. 9 is a plot of simulated peak gain of an antenna array according to the disclosure.

FIG. 9 is a plot of the simulated peak gain from 4 GHz to 8 GHz for a 2×1 antenna array according to the disclosure. Traces on the plot represent results for antenna 1 port 1 peak gain 910, antenna 1 port 2 peak gain 920, antenna 2 port 1 peak gain 930, and antenna 2 port 2 peak gain 940. Antenna 1 port 1 peak gain 910 reaches a maximum value of approximately 7.9 dB at approximately 5.6 GHz. Antenna 1 port 2 peak gain 920 reaches a maximum value of approximately 8.4 dB at approximately 5.75 GHz. Antenna 2 port 1 peak gain 930 reaches a maximum value of approximately 8.0 dB at approximately 5.75 GHz. Antenna 2 port 1 peak gain 940 reaches a maximum value of approximately 8.6 dB at approximately 5.75 GHz.

Figure 10:
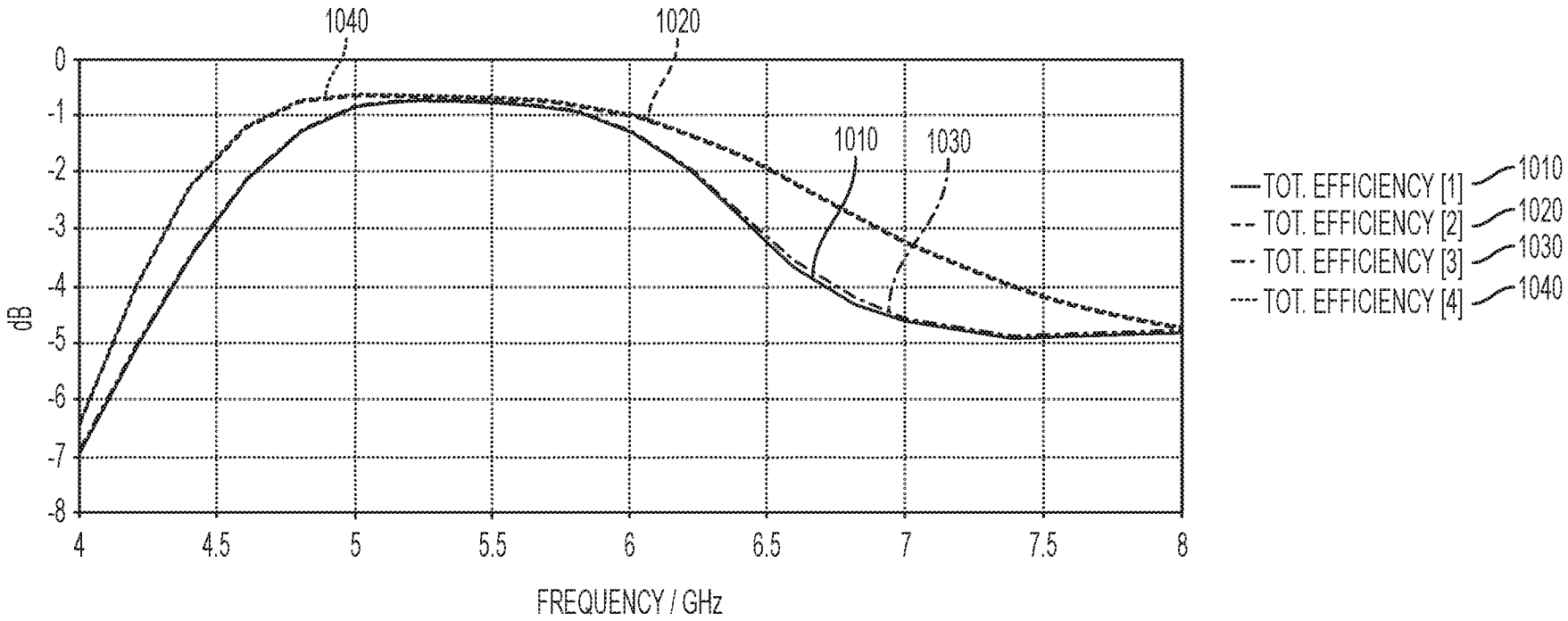
FIG. 10 is a plot of simulated average gain of an antenna array according to the disclosure.

FIG. 10 is a plot of the simulated average gain from 4 GHz to 8 GHz for a 2×1 antenna array according to the disclosure. Traces on the plot represent results for antenna 1 port 1 average gain 1010, antenna 1 port 2 average gain 1020, antenna 2 port 1 average gain 1030, and antenna 2 port 2 average gain 1040. Note that the results for antenna 1 port 1 average gain 1010 and antenna 2 port 1 average gain 1030 are almost identical, deviating from one another only slightly. In addition, the results for antenna 1 port 2 average gain 1020 and antenna 2 port 2 average gain 1040 are so close as to be indistinguishable on the plot. Antenna 1 port 1 average gain 1010 and antenna 2 port 1 average gain 1030, range from a maximum value of approximately −0.75 dB at approximately 5.2 GHz to a minimum value of approximately −1.3 dB at 6.0 GHz. Similarly, antenna 2 port 1 average gain 1030 and antenna 2 port 2 average gain 1040, range from a maximum value of approximately −0.7 dB at 5.0 GHz to a minimum value of approximately −1.0 dB at 6.0 GHz.

In operation, the antenna array is dual linear polarized to transmit on one polarization and receive on an opposite polarization. This results in zero interference between the transmitting signals and the received signals. The microstrip patches act as the radiating elements. The microstrip patches are coupled with the apertures in the ground plane to excite radiation in a desired frequency, this allows the antenna array to provide phase shift needed for beam steering. The metal backplate mechanically holds the weight of 128 low loss RF cables and acts as a reflector to the existing radiation to improve directionality and gain of each individual antenna element. The stacked substrate design allows for an ultra-wide band coverage allowing >7 dBi peak gain per antenna. An 8×8 element panel, as illustrated has >28 dBi effective peak gain. This gain can be increased with the use of a conductive plate reflector mounted behind the PCB panels.

Figure 11A:
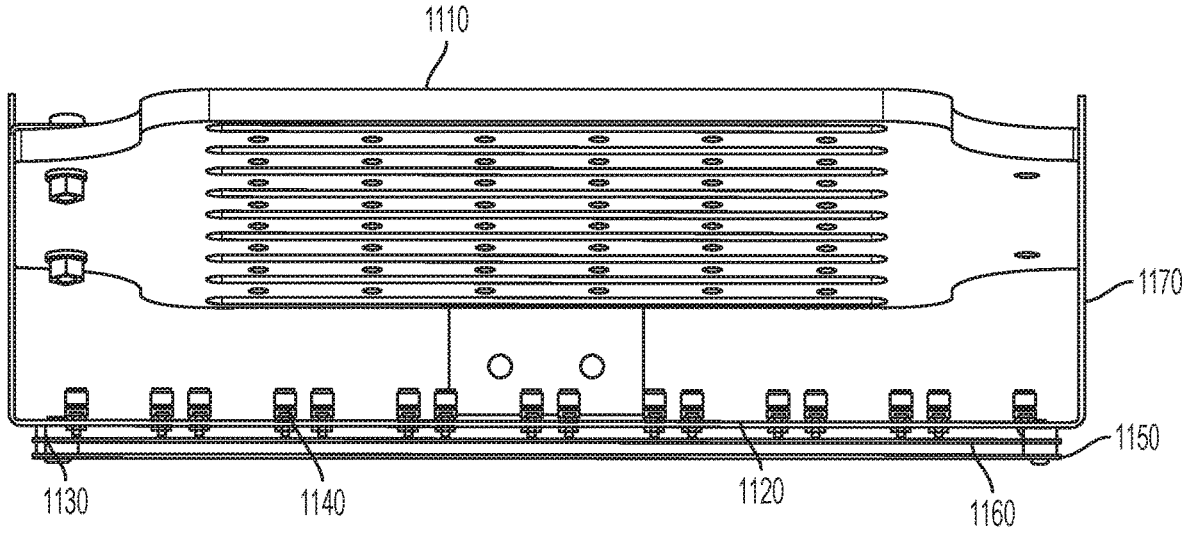
FIGS. 11A-B illustrate a mounted antenna array.
Figure 11B:
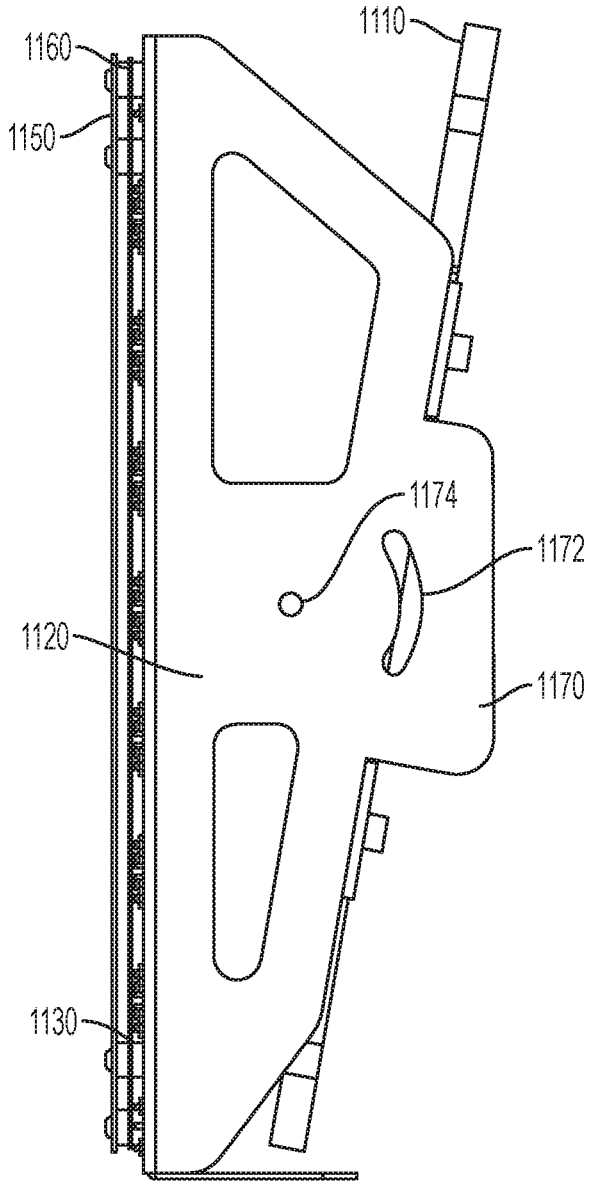

FIGS. 11A-B illustrate a mounted antenna. In this configuration, the antenna array is secured to a U-shaped frame 1170. A plurality of SMA connectors 1140 are positioned along the bottom of the U-shaped frame 1170. A cable holder 1110 is positioned towards the open end of the U-shaped frame 1170. The first substrate 1150 and the second substrate 1160 are positioned below the bottom of the U-shaped frame 1170. The first substrate 1150 and the second substrate 1160 correspond to the substrates shown in FIG. 3. As will be appreciated by those skilled in the art, the upper layer shown in FIG. 3B is not readily visible this view because the thickness of the layer compared to the substrate is very thin.

The cable holder 1110 can be a plastic support for the cables that connect to each SMA connector 1140. As shown above, the system can have, for example, 128 cables. Each cable would lead to a separate radio for each antenna and the cable holder 1110 is configured to support cable ties for the cables, thus allowing the cables to be secured and neatly positioned. As will be appreciated by those skilled in the art, there is no shape limitation to the cable holder 1110. Other shapes can be employed if the size and/or volume of the shape will serve the desired function. For example, where the size and shape can be used to secure a conductive back panel and hold the weight of each cable. A metal flap can optionally be provided which is used to mount the entire holder to a pole mount.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An antenna comprising:

a first substrate;

a ground plane positioned on a first side of the first substrate wherein the ground plane comprises two or more coupling apertures and two or more feed pin apertures passing through the first substrate;

a micro-strip layer on a second side of the first substrate further comprising at least one pair of micro-strip elements wherein each element of the pair of micro-strip elements comprises a first end and a second end and further wherein the micro-strip element engages one of the feed pin apertures; and a second substrate positioned on the micro-strip layer of the first substrate wherein the second substrate comprises one or more patches.

2. The antenna of claim 1 wherein the ground plane further comprises a first coupling aperture and a second c-shaped coupling aperture.

3. The antenna of claim 1 wherein the pair of micro-strip elements further comprises a first leg positioned substantially perpendicular to a second leg.

4. The antenna of claim 3 wherein the first leg and the second leg have the same length.

5. The antenna of claim 3 wherein the first leg and the second leg have different lengths.

6. The antenna of claim 5 wherein the antenna is an array of coupling apertures, feed pin apertures, micro-strip elements, and patches, the array further comprises 64 antenna elements.

7. The antenna of claim 6 wherein the 64 antenna element array has >28 dBi effective peak gain.

8. The antenna of claim 1 wherein the antenna is a 5-6 GHz wideband dual-polarized MIMO array antenna.

9. The antenna of claim 1 wherein each aperture coupled patch has >7 dBi peak gain.

10. A single panel MIMO array comprising:

a first substrate;

a ground plane positioned on a first side of the first substrate wherein the ground plane comprises a row of aperture clusters in a first direction and a column of aperture clusters in a second direction;

a micro-strip layer on a second side of the first substrate further comprising a row of micro-strip elements in a first direction and a column of micro-strip elements in a second direction wherein each element of the microstrip elements comprises a first end and a second end and further wherein each of the micro-strip elements engages a feed pin aperture of one of the aperture clusters on the ground plane; and a second substrate positioned on the micro-strip layer of the first substrate wherein the second substrate comprises a row of patches in a first direction and a column of patches in a second direction, wherein the array has an effective peak gain>28 dBi.

11. The single panel MIMO array of claim 10 wherein each aperture cluster further comprises a first coupling aperture and a second c-shaped coupling aperture.

12. The single panel MIMO array of claim 10 wherein the pair of microstrip elements have a first leg positioned substantially perpendicular to a second leg.

13. The single panel MIMO array of claim 12 wherein the first leg and the second leg have the same length.

14. The single panel MIMO array of claim 12 wherein the first leg and the second leg have different lengths.

15. The single panel MIMO array of claim 10 wherein the array is 64 antenna elements.

16. The single panel MIMO array of claim 10 wherein the antenna is a 5-6 GHz wideband dual-polarized MIMO array antenna.

17. The single panel MIMO array of claim 10 wherein each aperture coupled patch has >7 dBi peak gain.

18. A system comprising:

a mounting device further comprising a first surface engaging a plurality of SMA connectors, a pair of arms, and a cable holder positioned between the pair of arms, an antenna comprising a first substrate, a ground plane positioned on a first side of the first substrate wherein the ground plane comprises two or more coupling apertures and two or more feed pin apertures passing through the first substrate, a micro-strip layer on a second side of the first substrate further comprising at least one pair of micro-strip elements wherein each element of the pair of micro-strip elements comprises a first end and a second end and further wherein the micro-strip element engages one of the feed pin apertures, and a second substrate positioned on the micro-strip layer of the first substrate wherein the second substrate comprises one or more patches wherein the antenna engages the first surface of the mounting device; and a plurality of cables.

19. An antenna comprising:

a first substrate;

a ground plane disposed on a first side of the first substrate, the ground plane comprising a plurality of aperture clusters, each aperture cluster comprising at least a coupling aperture and a pair of feed pin apertures passing through the first substrate;

a plurality of pairs of microstrip elements disposed on a second side of the first substrate, each pair of microstrip elements located opposite an aperture cluster, each microstrip element of the pairs of microstrip elements being connected to a different one of the pair of feed pin apertures of the opposing aperture cluster; and a second substrate comprising one or more patches, the plurality of pairs of microstrip elements disposed between the ground plane and the second substrate.

20. The antenna of claim 19, wherein each of the one or more patches on the second substrate is vertically aligned with an aperture cluster and the pair of microstrip elements opposite the aperture cluster.

21. The antenna of claim 20, wherein each patch extends over at least a portion of the coupling aperture in the aperture cluster with which the patch is aligned.

22. The antenna of claim 20, wherein the feed pin apertures of each of the aperture clusters are located outward of the patch vertically aligned with that aperture cluster, such that the patch does not extend over the feed pin apertures.

* * * * *